US009895565B2

(12) United States Patent
Shchipsky

(10) Patent No.: US 9,895,565 B2
(45) **Date of Patent: *Feb. 20, 2018**

(54) FITNESS APPARATUS

(71) Applicant: Anatoly Shchipsky, Toronto (CA)

(72) Inventor: Anatoly Shchipsky, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/998,638

(22) Filed: Jan. 27, 2016

(65) Prior Publication Data

US 2017/0239505 A1 Aug. 24, 2017

(51) Int. Cl.
*A63B 1/00* (2006.01)
*A63B 17/02* (2006.01)
(Continued)

(52) U.S. Cl.
CPC ..... *A63B 17/02* (2013.01); *A63B 1/00* (2013.01); *A63B 3/00* (2013.01); *A63B 21/154* (2013.01);
(Continued)

(58) Field of Classification Search
CPC .... A63B 1/00; A63B 3/00; A63B 4/00; A63B 7/00; A63B 7/02; A63B 9/00; A63B 2009/006; A63B 17/00; A63B 17/02; A63B 17/04; A63B 21/00058; A63B 21/00069; A63B 21/00072; A63B 21/00076; A63B 21/00181; A63B 21/00185; A63B 21/002; A63B 21/0023; A63B 21/012; A63B 21/0125; A63B 21/015; A63B 21/06; A63B 21/0615; A63B 21/0616; A63B 21/0617; A63B 21/065; A63B 21/068; A63B 21/08; A63B 21/15; A63B 21/151; A63B 21/152; A63B 21/153; A63B 21/154; A63B 21/156; A63B 21/159; A63B 21/22; A63B 21/4027; A63B 21/4029; A63B 21/4033; A63B 21/4034; A63B 21/4035; A63B 21/4045; A63B 21/4047; A63B 21/4049; A63B 2023/006; A63B 23/02; A63B 23/0205; A63B 23/0211; A63B 23/0216; A63B 23/0222; A63B 23/0233; A63B 23/035; A63B 23/03516; A63B 23/03525; A63B 23/0355; A63B 23/03558;
(Continued)

(56) References Cited

U.S. PATENT DOCUMENTS 1,126,082 A * 1/1915 Reach ..... 482/23
1,628,745 A * 5/1927 Rumke ..... A63B 7/00 482/23

(Continued)

*Primary Examiner* — Andrew S Lo
*Assistant Examiner* — Gary D Urbiel Goldner

(57) ABSTRACT

A fitness apparatus for enabling numerous different fitness routines on a single piece of apparatus and having two side assemblies each having upright metal bars of hollow tubular construction each having fastening holes along its length, generally L-shaped junction portions of said upright bars of similar hollow tubular material and having fastening holes therealong, cross members extending between the two side assemblies holding them in spaced apart locations, floor rests on both side assemblies, a first fitness exercise attachment secured to one of the side assemblies, and, a second fitness exercise attachment, different from the first fitness exercise attachment, secured to the other of the side assemblies.

14 Claims, 4 Drawing Sheets

(51) Int. Cl.
*A63B 21/00* (2006.01)
*A63B 23/02* (2006.01)
*A63B 3/00* (2006.01)
*A63B 69/20* (2006.01)

(52) U.S. Cl.
CPC ..... *A63B 21/4029* (2015.10); *A63B 21/4034* (2015.10); *A63B 21/4035* (2015.10); *A63B 23/0205* (2013.01); *A63B 69/20* (2013.01); *A63B 2225/093* (2013.01)

(58) Field of Classification Search
CPC ..... A63B 23/03566; A63B 23/03575; A63B 23/03583; A63B 23/04; A63B 23/0405; A63B 23/0482; A63B 23/0488; A63B 23/0494; A63B 23/12; A63B 23/1209; A63B 23/1218; A63B 23/1227; A63B 23/1236; A63B 23/1245; A63B 23/1281; A63B 26/00; A63B 26/003; A63B 2026/006; A63B 69/0057; A63B 69/0059; A63B 69/0064; A63B 69/20; A63B 69/201; A63B 69/203; A63B 69/205; A63B 69/206; A63B 69/208; A63B 69/24; A63B 69/26; A63B 69/34; A63B 69/345; A63B 2069/0062; A63B 71/0054; A63B 71/02; A63B 71/023; A63B 2071/0063; A63B 2071/0072; A63B 2071/0081; A63B 2071/009; A63B 2071/026; A63B 2071/027; A63B 2208/02; A63B 2208/0204; A63B 2208/0242; A63B 2208/0247; A63B 2208/0252; A63B 2208/0257; A63B 2208/0285; A63B 2208/029; A63B 2208/0295; A63B 2210/50; A63B 2225/09; A63B 2225/093; A63B 2225/10; A63B 2225/102; A63B 2225/105; A63B 2225/107; A63B 2225/72
USPC ..... 482/142–145
See application file for complete search history.

(56) References Cited

U.S. PATENT DOCUMENTS 3,388,700 A * 6/1968 Mountz ..... A61H 1/0218 482/144
3,568,669 A * 3/1971 Stites ..... A61H 1/0218 5/610
3,722,507 A * 3/1973 Krause ..... A61G 13/00 606/237
4,214,790 A * 7/1980 Sieber ..... A61G 15/007 297/326
4,292,962 A * 10/1981 Krause ..... A61H 1/0218 482/142
RE31,092 E * 11/1982 Sieber ..... A61G 15/007 297/326
4,356,902 A * 11/1982 Murphy ..... A61H 3/008 193/35 R
4,503,845 A * 3/1985 Licciardi ..... A61H 1/0218 482/144
5,044,358 A * 9/1991 Morin ..... A61H 1/0218 482/144
5,178,590 A * 1/1993 Stephens ..... A63B 7/02 482/23
5,334,123 A * 8/1994 Rutherford ..... A61H 1/0218 482/111
5,876,314 A * 3/1999 Sugimura ..... A63B 19/04 482/144
6,394,932 B1 * 5/2002 Chu ..... A63B 1/00 482/34
7,361,128 B2 * 4/2008 Chen ..... A61H 1/0218 482/142
7,374,520 B1 * 5/2008 Licari ..... A63B 21/0608 482/144
7,544,157 B2 * 6/2009 Teeter ..... A61H 1/0218 482/144
7,625,327 B1 * 12/2009 Teeter ..... A61H 1/0218 482/144
7,857,741 B1 * 12/2010 Hsiung ..... A61H 1/0218 482/143
8,056,979 B2 * 11/2011 McBride ..... A47C 1/02 297/326
8,500,608 B1 * 8/2013 Bonomi ..... A63B 21/075 482/101
9,259,612 B2 * 2/2016 Meister ..... A63B 23/03566
9,526,667 B1 * 12/2016 Wang ..... A61H 1/0229
9,682,000 B2 * 6/2017 Behnke ..... A61G 7/1042
2004/0157713 A1 * 8/2004 Kweon ..... A61H 1/0218 482/144
2005/0003938 A1 * 1/2005 Henderson ..... A63B 21/068 482/143
2009/0054217 A1 * 2/2009 Teeter ..... A61H 1/0218 482/144
2012/0202656 A1 * 8/2012 Dorsay ..... A63B 23/1209 482/121
2014/0011650 A1 * 1/2014 Wei ..... A61H 1/0229 482/144
2014/0128228 A1 * 5/2014 Bonomi ..... A63B 21/0414 482/98
2014/0201905 A1 * 7/2014 Glukhovsky ..... A61G 7/1001 5/81.1 R

* cited by examiner

FITNESS APPARATUS

FIELD OF THE INVENTION

The invention relates to fitness apparatus, and in particular to such an apparatus consisting of an assembly of vertical and horizontal bars having numerous bolt holes at spaced intervals and connected together by bolts and having numerous attachment points carrying various different fitness attachments for facilitating various different physical exercises.

BACKGROUND OF THE INVENTION

Equipment for exercising the body, for fitness or for physical development, is shown in numerous different patents. Many of them involve moveable devices for specific fitness routines, with more or less resistance from springs or cylinders. These devices are often complex and costly. Shipping of such complex machines can be costly.

They usually occupy a relatively large footprint, and can often become disused due to the lack of variety of exercises available on them. They are usually capable of only one or two different exercise routines. Many of them require electrical power to operate the resistance devices, or the electronic displays.

Simpler forms of devices such as parallel bars are usually supported by being fixed to some building structure and have fixed proportions, and are suitable for only a few exercises Other forms of equipment, usually based on a simple see-saw principle, provide for inverting the human body into an upside down position. This, while not being an exercise device as such, is thought to be beneficial to overall fitness.

To keep all these different pieces of equipment, in a confined area, such as a spare room in a home for example, or even to provide them, in sufficient numbers, in a commercial or institutional facility is often simply impractical.

Clearly it would be desirable to combine as many as possible of these and other various fitness exercise functions into a single piece of universal equipment. Preferably the device would be adaptable for use by persons of different age, and different height and different physique. The equipment should preferably be operable without the use of power accessories requiring electrical power for operation.

Ideally the equipment would be suitable for shipping as a kit in a knocked-down, compact condition, and yet be suitable for erection in a fitness facility or even by the buyer in his home.

BRIEF SUMMARY OF THE INVENTION

With view to providing a fitness apparatus meeting these desirable criteria the invention comprises two side assemblies each having a plurality of upright metal bars of hollow tubular construction each having a plurality of fastening holes along its length, L-shaped junction members formed by upper extensions of said upright metal bars of similar hollow tubular material and having fastening holes therealong, cross members extending between said two side assemblies holding them in spaced apart locations, floor rests on both said side assemblies, and at least one fitness exercise attachment secured to one of said side assemblies, and another fitness exercise attachment secured to the other of said side assemblies.

Preferably there are several different such fitness exercise attachments attached to said apparatus.

Preferably one such attachment is a body inverter swing, mounted for swinging between said two side assemblies.

Preferably the body inverter consists of a rectangular enclosure having two upright bar side members and upper and lower cross bar members at opposite ends of said upright side members, and hand grips on one said cross member and foot grips on the other said cross member.

Preferably there are pivots on opposite side assemblies supporting said inverter, and a friction control for restricting swinging of said inverter.

Preferably the friction control has handles by which it is operable, the handles being located on the inverter itself such that they can be operated manually while the inverter is in use.

Preferably there is a manual swing control device connected to said inverter whereby an operator can swing said inverter manually.

Preferably there are attachments on the upper and lower transverse bars to which a body harness can be secured.

Preferably the upper and lower transverse bars of said inverter are moveable along said upright bars of said inverter to accommodate persons of differing height or different positions in the inverter.

Preferably there is an upper side extension is attached to one of said side assemblies projecting outwardly therefrom and punch bag attachments on said side extension for attachment of a punch bag thereto.

Preferably there are parallel hand and foot bars attached to one of said side assemblies.

Preferably there are exercise bars extending from one of said side assemblies for abdominal exercising.

Preferably there is a bench attached to one of said side assemblies for seated and prone exercises.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
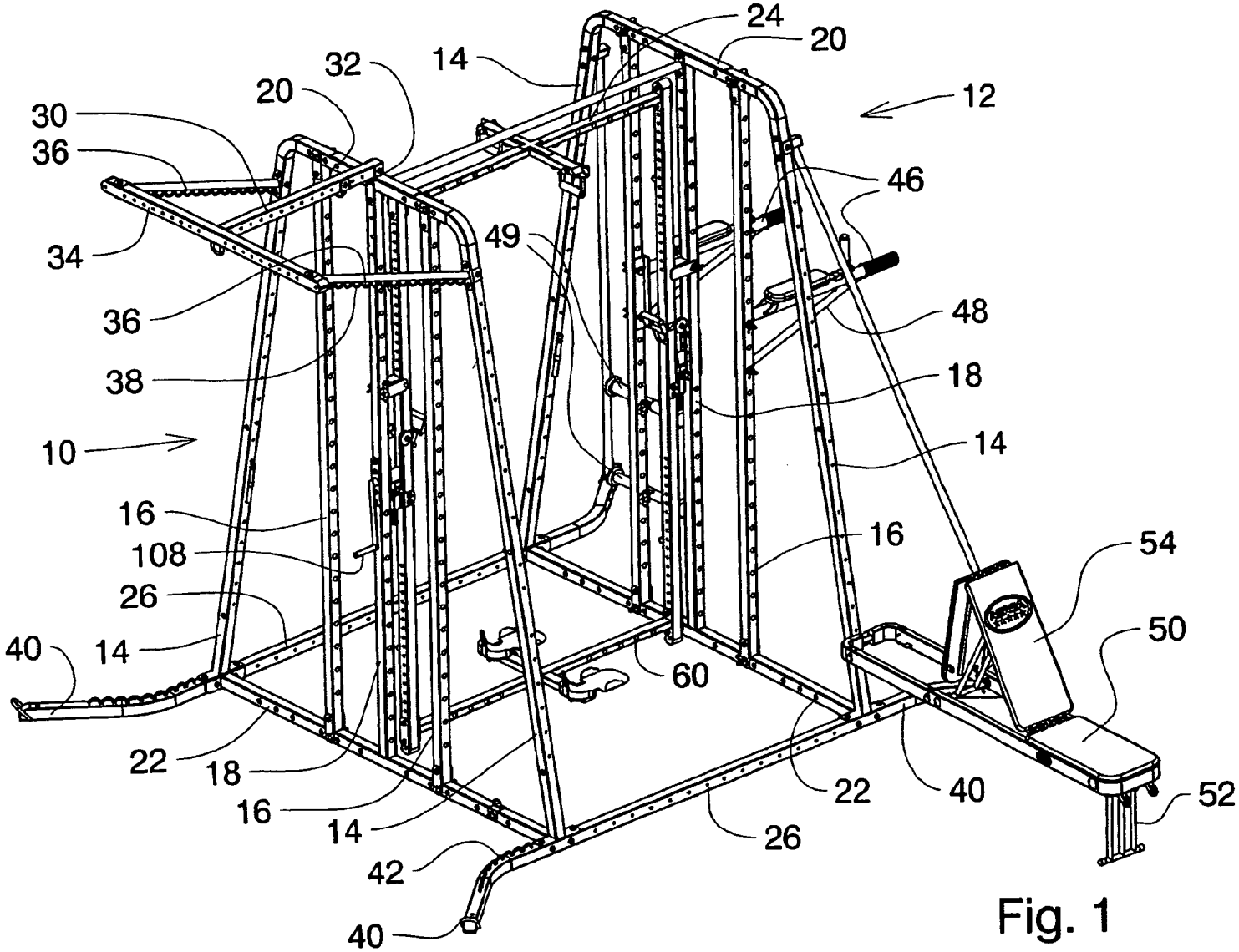
FIG. 1 is a perspective of a fitness apparatus illustrating the invention.

Referring first to FIG. 1 it will be seen that this illustrates one form of the invention, which in this case is a stand alone fitness apparatus, for enabling many different fitness routines to be performed, on the one apparatus.

The apparatus is fully functional as it stands, and does not require any power source, either for resistance, or for control, or display.

The apparatus comprises in this case first side assembly (10) and second side assembly (12), standing spaced apart from one another Each side assembly comprises a plurality of upright bars. In each case there are two angled upright bars (14) and two intermediate upright bars (16). A central upright bar (18) is located between the intermediate upright bars (16). The two angled upright bars (14), at their upper ends are formed into generally L-shaped junction portions (20). The junction portions are attached together to form a continuous horizontal support. Such attachment can be by welding, or by bolts and fastening flanges, (not shown) or any other suitable system. The upright bars (16) and (18) are attached at their tipper ends to L-shaped junction portions (20). The upright bars at their lower ends are attached to lower transverse bar (22).

The side assemblies (10) and (12) are connected to each other by a cylindrical tube (24) connected to both L=shaped junction portions (20). Tube (24) has flanges (not shown) at each end so that it can be, eg bolted, or secured to the L=shaped junction portions (20), where they join together.

It is possible to perform various routines using the cylindrical tube (24), which can simply be grasped by the hands. The side assemblies (10) and (12) are connected to each other by lower outer bars (26). Lower transverse bars (22) and lower outer bars (26) thus form a rectangular frame shape joining the bottoms of side assemblies (10) and (12).

Side assembly (10) is provided with an upper extension in the form of a central extension bar (30) extending normal to central upright bar (18) and connected as at (32) to the L=shaped junction portions (20), near the top of central upright bar (18). A transverse extension bar (34) is attached normal to central extension bar (30). Two angled extension bracket bars (36) are attached at their lower ends to angled upright bars (14). At their upper ends bracket bars (36) are attached to the respective ends of transverse extension bar (34), thus providing firm support for transverse extension bar (34).

A number of upper attachment rings (38) are secured to the undersides of bracket bars (36) and also to the under side of transverse extension bar (34) and central extension bar (30). These rings permit the attachment of a fitness device such as a punch bag, (not shown) which may have upper and lower elastic cords, in well known manner. The cords of a punch bag can thus be attached in various different configurations, dependent on the routines being performed with the bag.

Floor legs (40) extend outwardly from each side assembly (10) and (12). Lower attachment rings (42) are provided on the upper sides of floor legs (40) of side assembly (10). In this way the punch bag (not shown) can be supported in space, between the upper and lower rings away from the upright bars of the side assembly (10), leaving the bag free to swing and rebound without interference from the upright bars of the side assembly.

On the other side assembly (12) parallel hand and foot bars (44) may be attached, for example to one of the upright intermediate bars (16), for performing various fitness routines. The positions of the short hand and foot bars (44) can be adjusted to suit the routines being performed.

Similarly exercise bar sub-assemblies (46) can be provided. These are of right-angular triangle shape in elevation, and angled bracket bars (48), and having T-shaped flanges by which they can be attached to upright intermediate members (16) as shown.

The parallel bar assemblies (46) thus providing secure support for the many routines Bar assemblies (46) may be attached at various positions, and at different heights for example being attached to the upright intermediate members (16)

For seated and for prone routines bench (50) is attached to upright angled bar (14) of side assembly (12).

At its remote end bench (50) is supported on bench legs (52). Bench (50) may have an adjustable back rest (54), which may hinge up, or lay flat, depending on the routines being performed.

The various parts of the apparatus can be attached together in various ways. Bolts are one method. Welding would be another, and any other forms of attachment many be suitable in various circumstances.

Figure 2:
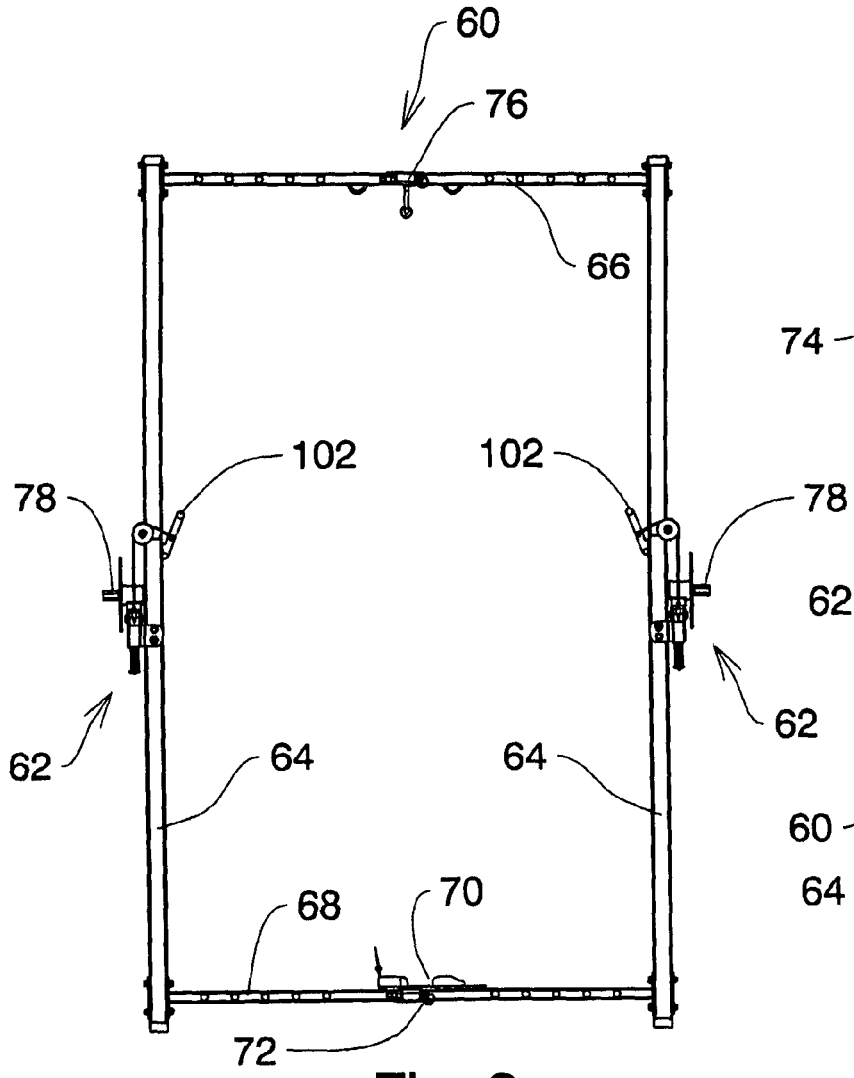
FIG. 2 is a front elevation of the inverter.
Figure 3:
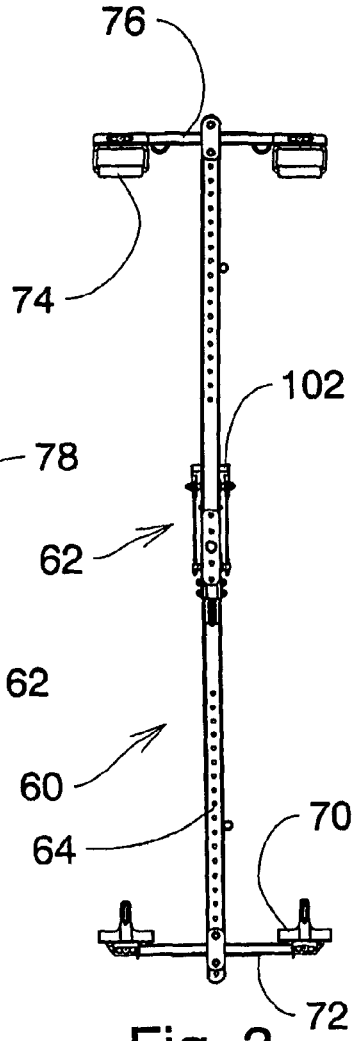
FIG. 3 is a side elevation of the inverter.
Figure 4:
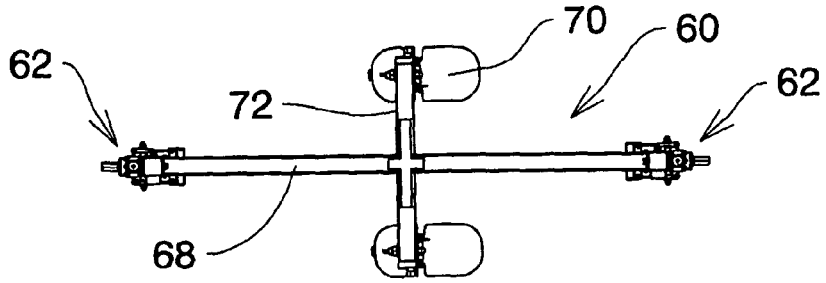
FIG. 4 is a top plan of the inverter.
Figure 6:
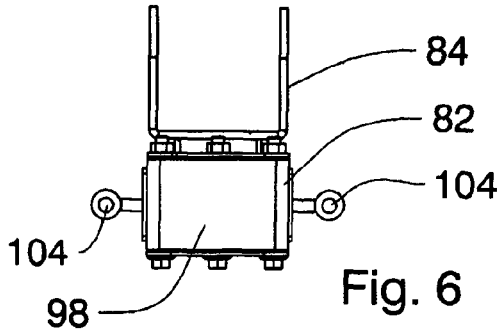
FIG. 6 is a top plan of the brake.
Figure 7:
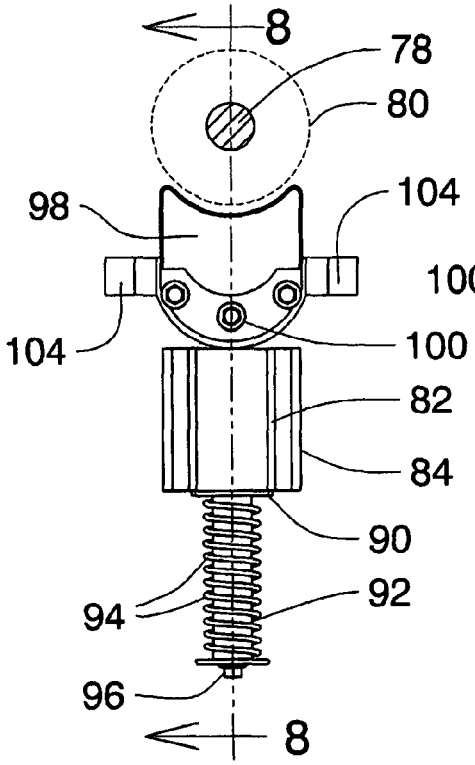
FIG. 7 is a side elevation of the brake.
Figure 8:
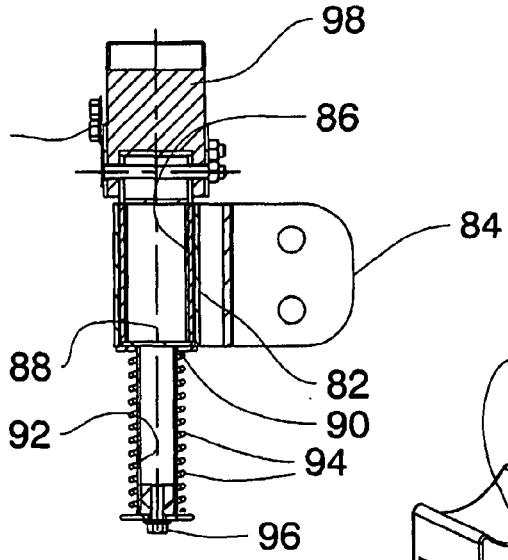
FIG. 8 is a section of the brake along 8-8 of FIG. 7.
Figure 5:
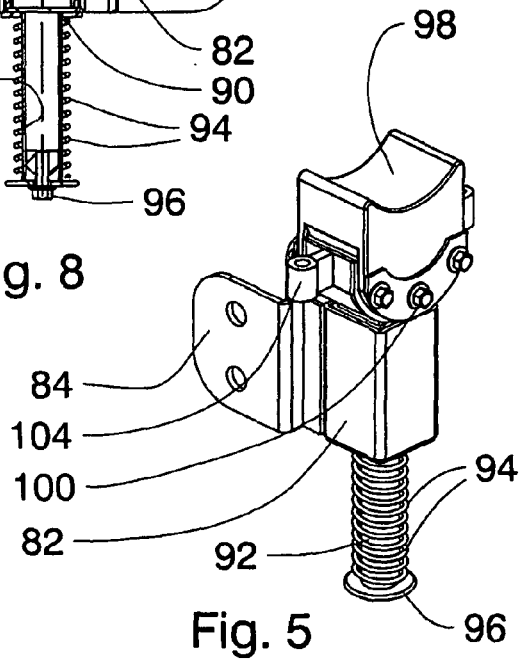
FIG. 5 is a perspective of the brake mechanism of the inverter.
Figure 9:
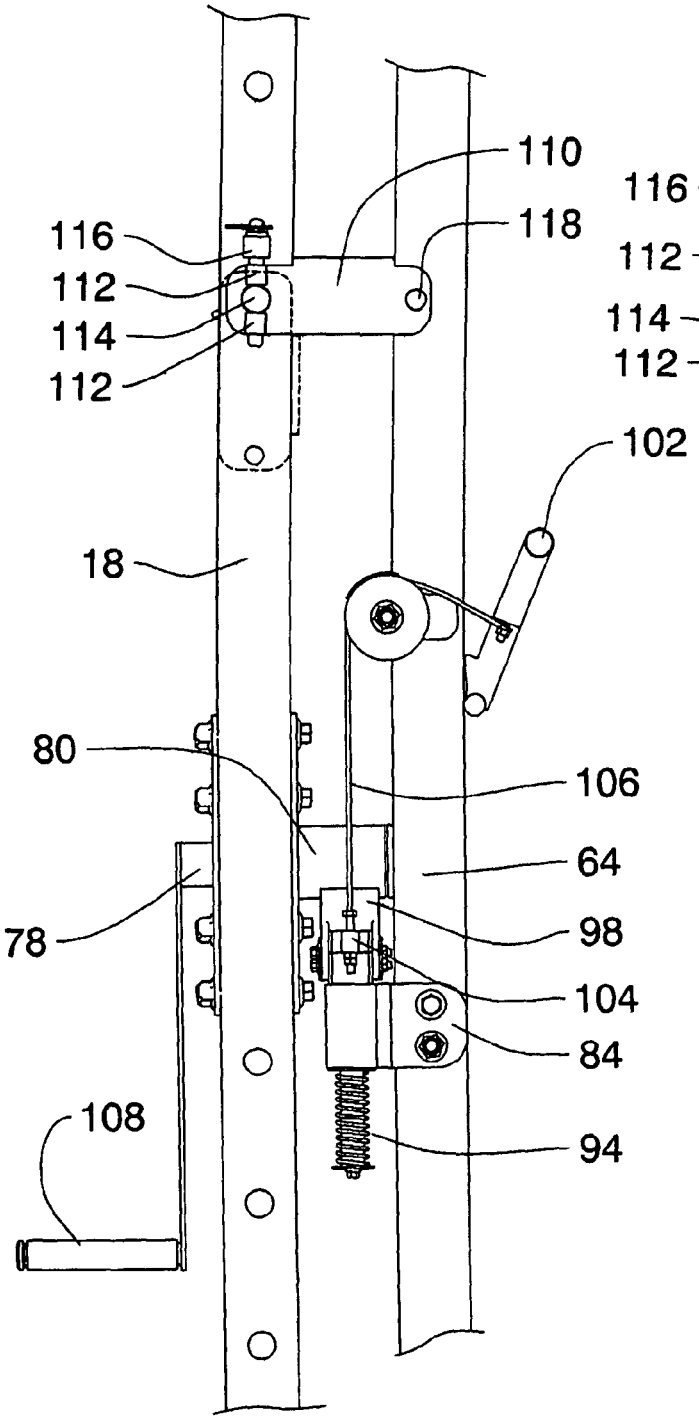
FIG. 9 is a front elevation of the friction assembly for the inverter, and showing a latch device; and, FIG. 10 is a side elevation of FIG. 9.
Figure 10:
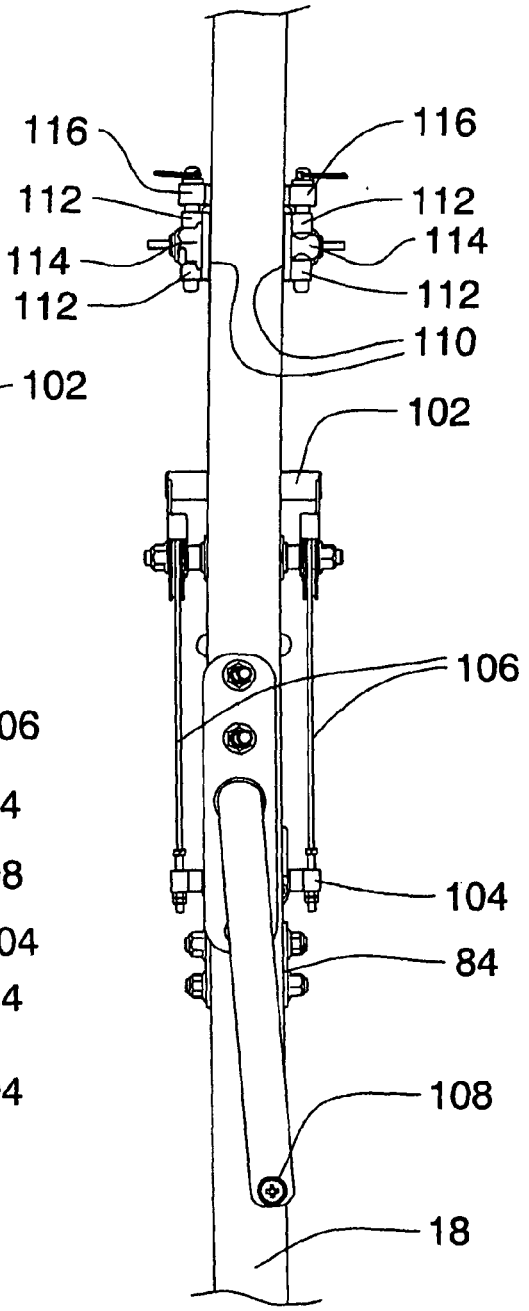

For additional routines a body inverter swing (60), FIGS. 2, 3, and 4, is mounted between side assemblies (10) and (12), by means of swing supports (62), fastened to respective side assemblies, on central upright bars (18).

Body inverter (60) comprises two side bars (64) and top rail (66) and bottom rail (68) forming a rectangular enclosure. Top rail (66) and bottom rail (68) can be adjusted up or down side bars (64) to accommodate persons of varying stature, or to provide for different positions within the inverter.

A body harness (now shown) may be provided having straps and hooks. It can be secured, for example, to top rail (66). In this way a person can be secured with their centre of gravity aligned with the swing supports (62).

Alternatively the person can be supported with their centre of gravity offset relative to swing supports (62). This will enable various different inverter movement routines. Foot plates (70), with straps (not shown), are attached on lower cross bar (72) which is itself attached transversely to bottom rail (68). Hand grips (74) are attached to upper cross bar (76) which is attached transversely to top rail (66).

There are two swing supports, one on each side. A swing support (62) is shown in more detail in FIGS. 2, and 5, 6, 7, and 8.

Each swing support (62) It has a shaft (78), received in a suitable bearing (not shown) in respective central uprights bars (18). Shaft (78) carries a brake drum (80). Frictional engagement of drum (80) is performed by the brake mechanism shown in FIGS. 5, 6, 7, and 8.

A rectangular sleeve (82) has two cheek plates (84) which are secured to the side bars (64) of the inverter. Within sleeve (82) a rectangular tube (86) is slidable up or down. Tube (86) has a base closure (88) A stop plate (90) secured at the bottom of sleeve (82) has a central opening.

A cylindrical column or rod (92) is attached to rectangular sleeve (82) and extends through the opening in closure (88) A spring (94) surrounds column (92) and is secured by bolt and washer (96). The upper end of spring (94) rides up against stop plate (90). In this way column (92) can slide up within sleeve (82) but is urged down by spring (94). On the upper end of column (92) an arcuate brake shoe (98) is supported by bolts (100). Brake shoe (98) defines an arc less than a semicircle, and matches the outside contour of drum (80), shown in phantom. Upward movement of the shoe (98) will cause friction on drum (80) and will control or stop rotation of shaft (78).

The brakes can be operated by brake levers (102) swingably mounted on each side bar (64) of inverter (60).

Brake shoe (98) has two brake cable sockets (104). Ends of brake cables (106) are secured in sockets (104). The other ends of the brake cables extend around pulleys and are secured to brake lever (102).

Operation of the levers will draw the brake shoes (98) up against the drums (80) and apply a retarding effect.

It may also be required that a trainer shall operate the inverter. For this purpose a manual rotation handle (108), (FIG. 1) is provided which is attached on a central side bar (18), to shaft (78).

It may be desirable to lock inverter (60) to prevent it swinging.

A latch is provided on each central bar (18) for engaging the upright side bar (64) of the inverter. The latch comprise a swing lock am (110) of inverted three sided channel shape in section, swingably mounted on each central bar (18).

Latch (110) has a pivot hole and two pin sleeves (112).

A pivot bolt (114) passes through central upright (18), and through latch (110)

A pin (116) can be passed through sleeves (1120 and through holes in the ends of the pivot bolts (114) to hold the latches in their deployed horizontal position, engaging the inverter. By releasing the pins (116), the latches can swing down away from the inverter.

The latches have knobs (118) to facilitate manual manipulation

A person can thus safely get into or out of the inverter without risk of it suddenly swinging free.

After releasing the pins (116) from sleeves (112) and bolt (114), allowing the latches to fall away, he can then carry out inversion routines as desired.

It will be understood that in some circumstances a simplified apparatus can be provided. By using one only of the side assemblies, and by simply adding extra legs, for example adding legs from a second side assembly, and attaching them to a single side assembly, many of the routines possible with the two assembly version can also be carried out In this case however the inverter itself would also be absent.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fitness apparatus for enabling numerous different fitness routines on a single piece of apparatus and comprising:

two side assemblies each said side assembly having:

a pair of angled upright bars of hollow tubular construction each having a plurality of fastening holes along its length;

a central upright bar between said angled upright bars;

intermediate upright bars between respective said angled upright bars, whereby said intermediate upright bars are positioned on either side of said central upright bar;

generally L-shaped junction portions on upper ends of respective said angled upright bars, connecting said angled upright bars;

an upper cross bar extending from one side assembly to the other and connecting said generally L-shaped junction portions of said angled upright bars of said side assemblies;

lower cross members extending between said two side assemblies holding lower ends of said two side assemblies in spaced apart locations;

floor rests extending below both said side assemblies;

a first fitness exercise attachment secured to one of said side assemblies, a second fitness exercise attachment, different from said first fitness exercise attachment, secured to the other of said side assemblies;

a body inverter, mounted for swinging between said two side assemblies, said body inverter including: a rectangular enclosure having two upright spaced apart side members and upper and lower cross members extending between opposite ends of said upright side members, and hand grips on said upper cross member and foot supports on said lower cross member, wherein the upper cross member of said body inverter is moveable along said upright side members of said body inverter to accommodate persons of differing stature;

pivots respectively on opposite side assemblies supporting said body inverter for swinging movement;

brake drums of cylindrical shape respectively on said pivots, brake shoes of semi-cylindrical shape respectively engageable with said brake drums, each said brake shoe being mounted on a moveable post and a slide device supporting said moveable post with a spring urging said brake shoe out of engagement with its respective said brake drum and wherein said slide device comprises a rectangular tube fastened to said respective upright side member, and said moveable post being slidable within said rectangular tube.

2. The fitness apparatus for enabling numerous different fitness routines on the single piece of apparatus as claimed in claim 1 including a shaft extending from said moveable post, out of said rectangular tube, said spring being carried on said shaft, and a stop on said rectangular tube engaging said spring;

cable anchors on said moveable post, and cables attached thereto, and brake operating handles respectively on said upright side members of said body inverter, said cables being respectively connected to said handles for manual operation of said brake shoes.

3. The fitness apparatus for enabling numerous different fitness routines on the single piece of apparatus as claimed in claim 2 including a foot a support bar mounted transversely and centrally on said lower cross member of said body inverter, and a hand support bar mounted transversely and centrally on said upper cross member of said body inverter, and said foot supports being fastened on opposite ends of said foot support bar and said hand grips being fastened on opposite ends of said hand support bar.

4. The fitness apparatus for enabling numerous different fitness routines on the single piece of apparatus as claimed in claim 3 including a manual operating handle connected to said body inverter whereby an operator can swing said body inverter manually.

5. The fitness apparatus for enabling numerous different fitness routines on the single piece of apparatus as claimed in claim 4 including axles respectively on each of said upright side members of said body inverter passing through respective said central upright bars of respective said side assemblies, and respective said brake drums being mounted on respective said axles.

6. The fitness apparatus for enabling numerous different fitness routines on the single piece of apparatus as claimed in claim 5 including cheek plates respectively on each of said rectangular tubes fitting around respective said upright side members of said body inverter, and being secured thereto.

7. The fitness apparatus for enabling numerous different fitness routines on the single piece of apparatus as claimed in claim 6 including an upper side extension attached to one of said side assemblies projecting outwardly therefrom, and wherein said upper side extension has angled bars located at an upward angle extending away from said side assembly, defining lower inward ends and upper outer ends, and including fastening attachment plates for the lower inward ends of said angled upright bars, lying against said upright bars of said side assembly, a transverse extension bar connected between said upper outer ends of said angled bars and a central bracing bar attached to said central upright bar and connecting to said transverse extension bar, and a plurality of attachment members on said upper side extension, for attachment of fitness equipment thereto.

8. The fitness apparatus for enabling numerous different fitness routines on the single piece of apparatus as claimed in claim 7 and including an upper end portion of one said central upright bar attached to said L-shaped junction portions, and said central bracing bar being secured to said upper end portion of said central upright bar and said L-shaped junction portions.

9. The fitness apparatus for enabling numerous different fitness routines on the single piece of apparatus as claimed in claim 8 including parallel bars attached to one of said side assemblies.

10. The fitness apparatus for enabling numerous different fitness routines on the single piece of apparatus as claimed in claim 9 including hand bars extending from one of said side assemblies for abdominal exercising, and adjustable fastenings on the hand bars whereby they may be secured to said side assembly at varying heights, and angled bracket rods extending between said hand bars and said side assembly.

11. The fitness apparatus for enabling numerous different fitness routines on the single piece of apparatus as claimed in claim 10 including a bench attached to one of said side assemblies for seated and prone exercises, and bench attachments on an end of said bench for attaching said end to the one of said side assemblies at varying heights.

12. The fitness apparatus for enabling numerous different fitness routines on the single piece of apparatus as claimed in claim 11 including floor legs extending outwardly from lower transverse bars of said side assemblies.

13. The fitness apparatus for enabling numerous different fitness routines on the single piece of apparatus as claimed in claim 12 and including, on one of said floor legs of one said side assembly, attachments for connecting a fitness equipment system thereto.

14. The fitness apparatus for enabling numerous different fitness routines on the single piece of apparatus as claimed in claim 13 including a latch device engageable between said body inverter and at least one said side assembly, operable to lock said body inverter in an upright position.

* * * * *